US007555899B2

(12) United States Patent
Maier et al.

(10) Patent No.: US 7,555,899 B2
(45) Date of Patent: Jul. 7, 2009

(54) REGULATOR DEVICE AND A VALVE UNIT FOR A HYDRAULIC PUMP

(75) Inventors: Hermann Maier, Waldachtal (DE); Roland Belser, Haigerloch (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 462 days.

(21) Appl. No.: 10/530,260

(22) PCT Filed: Oct. 9, 2003

(86) PCT No.: PCT/EP03/11216

§ 371 (c)(1),
(2), (4) Date: Apr. 5, 2005

(87) PCT Pub. No.: WO2004/036042

PCT Pub. Date: Apr. 29, 2004

(65) Prior Publication Data

US 2006/0043787 A1 Mar. 2, 2006

(30) Foreign Application Priority Data

Oct. 11, 2002 (DE) ..... 102 47 665

(51) Int. Cl.
*F16D 31/02* (2006.01)

(52) U.S. Cl. ..... 60/452

(58) Field of Classification Search ..... 60/452
See application file for complete search history.

(56) References Cited

U.S. PATENT DOCUMENTS

| | | | | |
|---|---|---|---|---|
| 2,238,063 | A | 4/1941 | Kendrick | |
| 4,132,506 | A * | 1/1979 | Dantlgraber | 60/452 |
| 6,179,570 | B1 | 1/2001 | Smith | |

FOREIGN PATENT DOCUMENTS

| | | |
|---|---|---|
| DE | 44 23 629 A1 | 1/1996 |
| DE | 199 530 170 A1 | 5/2001 |

OTHER PUBLICATIONS

English language Abstract of Japanese Patent No. 04136489 A, dated May 11, 1992.

* cited by examiner

*Primary Examiner*—F. Daniel Lopez
(74) *Attorney, Agent, or Firm*—Scully, Scott, Murphy & Presser, P.C.

(57) ABSTRACT

The invention relates to a regulator device (1) for a hydraulic pump which pumps into at least one working pipe (13), and to a valve unit for said pump. The pumping volume of the hydraulic pump (1) is regulated with the aid of a regulator device (15, 19) exposed to a regulating pressure which is regulated by an adjusting valve (26) in conformity to a first and a second pressure. The first pressure passes through a first pressure pipe (38) and acts on a first measuring surface, the second pressure passes through a second pressure pipe (39) and acts on a second pressure surface opposite to the first surface of the adjusting valve (26), the first pressure being higher than the second pressure. Said invention is characterized in that a pressure chamber (45) is arranged between the first and second measuring surfaces, thereby forming a discharge channel towards the second pressure pipe (39).

6 Claims, 4 Drawing Sheets

REGULATOR DEVICE AND A VALVE UNIT FOR A HYDRAULIC PUMP

Figure 1:
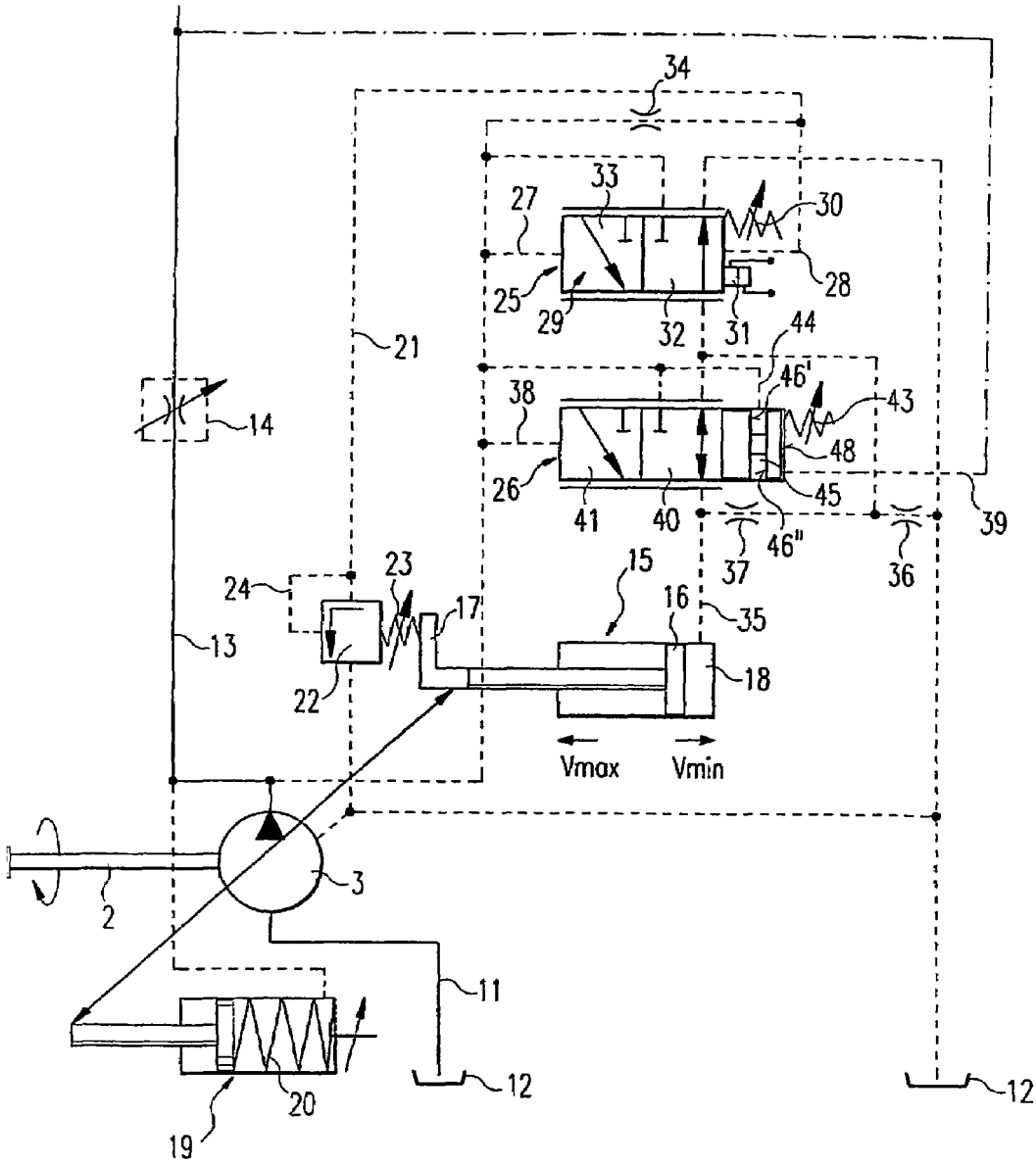

The invention relates to a control apparatus for a hydraulic pump, the displacement volume of which is adjustable by means of an adjusting device. The invention further relates to a valve block for such a control apparatus.

A control apparatus as well as a valve block for such a control apparatus for adjustable hydrostatic piston engines is known e.g. from DE 199 53 170 A1. The control apparatus comprises a capacity control valve as well as a volumetric flow control valve. The capacity control valve and the volumetric flow control valve are disposed in a common valve block. Both control valves comprise a valve piston, which is loaded at one side with the delivery-side pressure of the hydraulic pump. The valve piston of the volumetric flow control valve is loaded in the opposite direction by a pressure removed from a working line, wherein the removal point in the working line is disposed downstream of a volumetric flow throttle. The pressure-loaded surfaces are formed at the two ends of the valve piston that are remote from one another. If the working pressure is below a limit value, then the adjusting device of the hydraulic pump is determined exclusively by the volumetric flow control valve. For this purpose, in an actuating pressure chamber of the adjusting device an actuating pressure is set, which is set by the volumetric flow control valve in accordance with the falling pressure at the volumetric flow throttle.

The valve pistons are displaceable in axial direction in each case in a bore of the valve block, so that for a ready response upon a change of pressure the fit between the sealing portions of the valve block and the bore in the valve block has to be selected in such a way that even a slight action of force results in axial displacement of the valve pistons. The gap dimensions entailed by the fit lead to the development of a slight leakage flow in the direction of the volumetric flow control valve. This leakage flow carries small dirt particles, which are situated in the line system, in the direction of the valve piston. These dirt particles are deposited at the annular gap, which is formed in the region of the sealing portion and acts as a filter, and therefore lead to damage of the running path of the piston and/or valve surface. Besides the impairment of the sealing action of the sealing portion caused thereby, in extreme cases a jamming of the valve piston may even occur.

The underlying object of the invention is to provide a control apparatus as well as a valve block for a control apparatus, by means of which a depositing of dirt particles in the region of the valve piston is reliably prevented.

The object is achieved by the control devices according to the invention having the features of claim 1 as well as by the valve block having the features of claim 6.

According to the invention, at the valve piston a pressure chamber is formed, which is connected by a line or channel to the delivery-side working pressure connection. The pressure chamber is separated by a sealing portion from an end face of the valve piston, wherein acting upon the end face of the valve piston is a pressure, which is lower than the pressure at the delivery-side working pressure connection. The unavoidable leakage in the region of the sealing portion runs in accordance with the prevailing pressure gradient in the direction leading out of the valve so that, instead of the contaminated leakage fluid, the annular gap around the sealing portion of the valve piston is rinsed with clean leakage fluid. Deposits in the region of the valve piston are therefore reliably prevented and wear of the valve piston and/or of the corresponding running surface is avoided.

Advantageous developments of the control apparatuses according to the invention and of the valve block according to the invention are possible by virtue of the measures outlined in the sub-claims.

In particular, it is advantageous for the pressure chamber to take the form of an annular chamber, wherein the two delimiting portions are constructed as sealing portions, so that the pressure fed into the pressure chamber exerts no force in axial direction upon the valve piston.

It is further advantageous for the connection to be produced by means of a counterpressure channel, which extends as a longitudinal bore in the interior of the valve piston and which is connected by a connection bore to the pressure chamber. A further advantage is that a longitudinal bore, which is in any case already provided in the interior of the valve piston, may be utilized by virtue of lengthening thereof. Additional tools or further operations are therefore not required, with the result that there is hardly any increase in cost compared to the known valve block.

Figure 2:
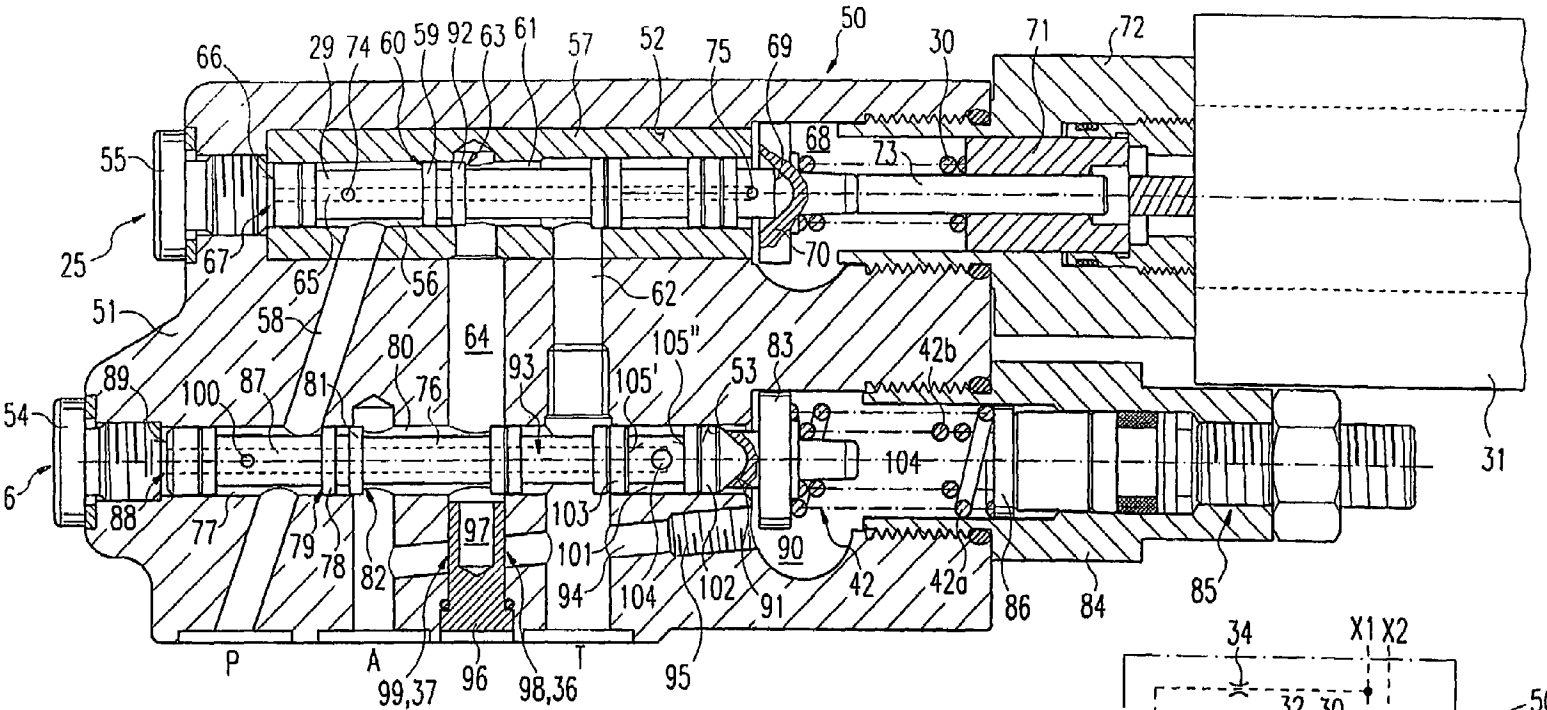
Figure 3:
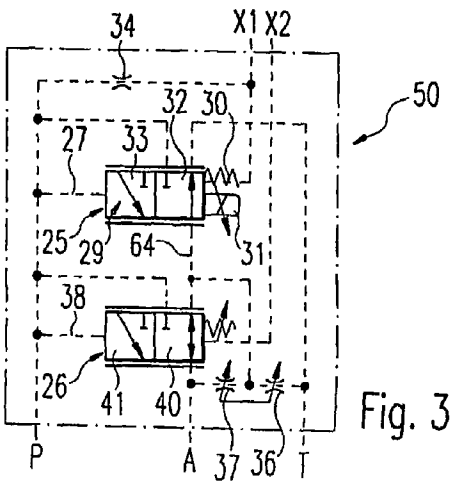
Figure 4:
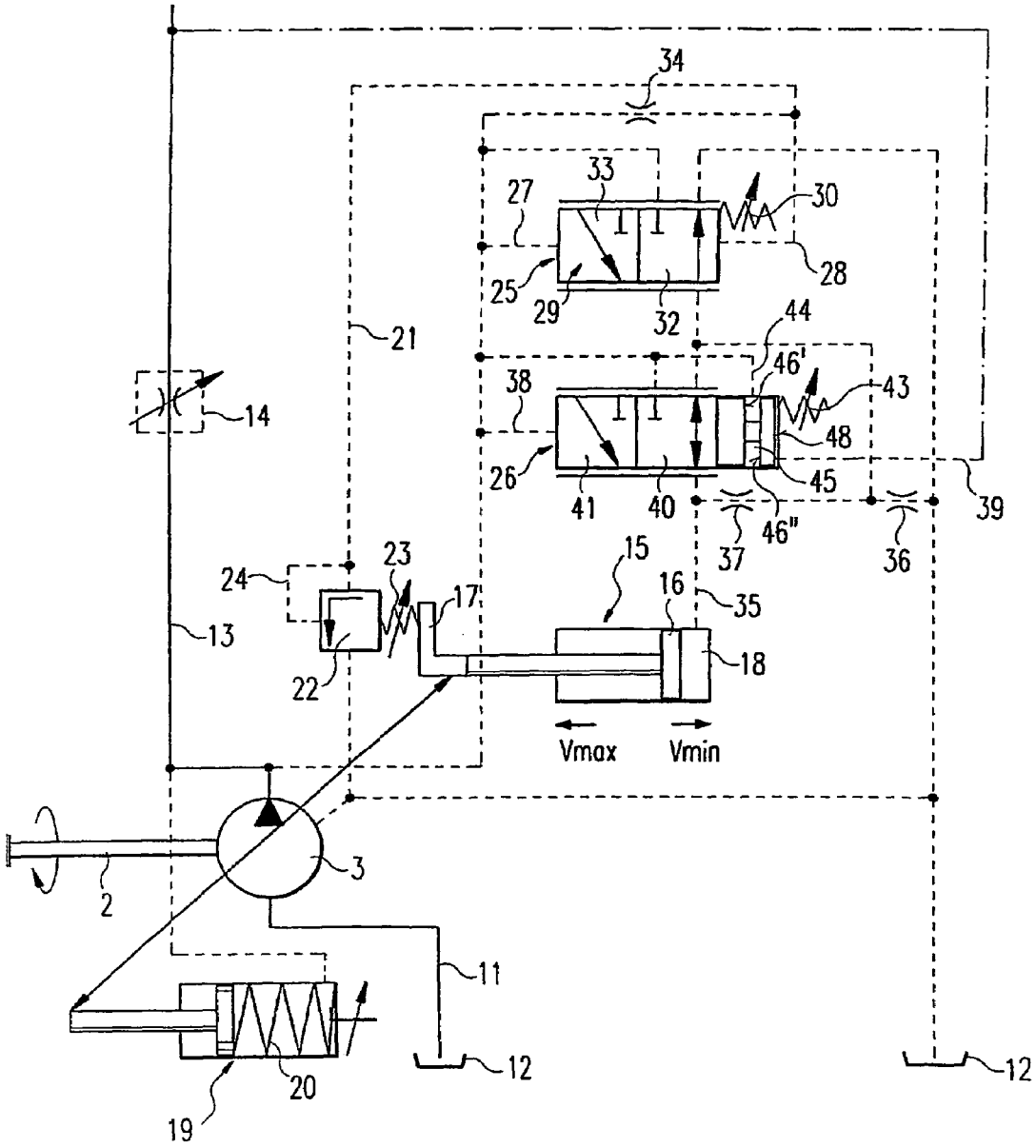
Figure 5:
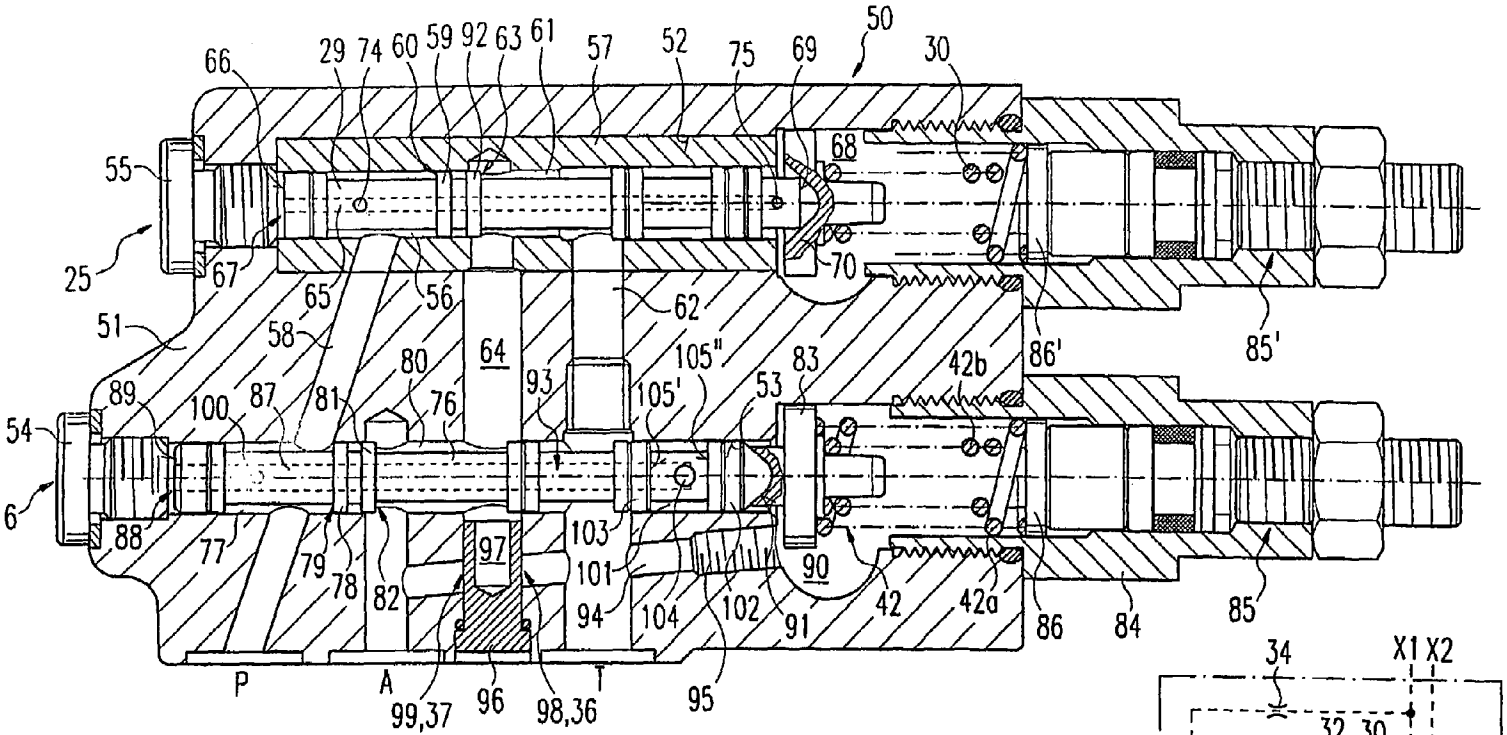
Figure 6:
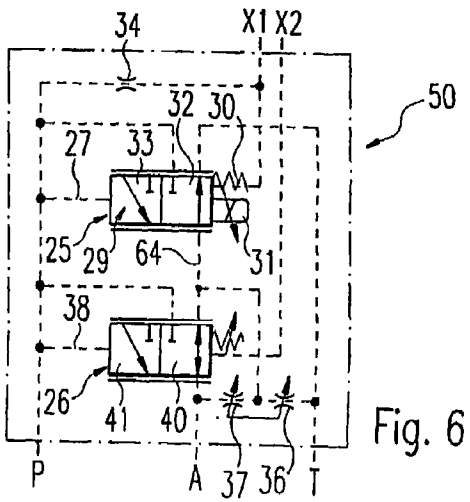

There now follows a detailed description of preferred embodiments of the invention with reference to the drawings. The drawings show:

FIG. 1 a hydraulic circuit diagram of a first embodiment of the control apparatus according to the invention, FIG. 2 an embodiment of a valve block according to the invention for the first embodiment of the control apparatus according to the invention, FIG. 3 a hydraulic equivalent circuit diagram of the valve block according to the invention illustrated in FIG. 2, FIG. 4 a hydraulic circuit diagram of a second embodiment of the control apparatus according to the invention, FIG. 5 an embodiment of a valve block for the second embodiment of the control apparatus according to the invention, and FIG. 6 a hydraulic equivalent circuit diagram of the valve block according to the invention illustrated in FIG. 5.

FIG. 1 shows an embodiment of a control apparatus 1 according to the invention, which allows a variation of the limiting maximum capacity.

A hydraulic pump 3 is driven via the shaft 2 e.g. by a non-illustrated internal combustion engine, takes in hydraulic fluid from a hydraulic fluid tank 12 through a suction line 11 and delivers the hydraulic fluid to a working line 13, in which a volumetric flow throttle 14 is disposed. The displacement volume of the hydraulic pump 3 is adjustable by means of an adjusting device 15. The adjusting device 15 comprises an actuating piston 16, which is connected to a linkage 17 and loaded by the actuating pressure prevailing in an actuating chamber 18. The adjusting device 15 further comprises a resetting device 19 having a resetting spring 20. Provided no actuating pressure prevails in the actuating chamber 18, the resetting spring 20 swivels the hydraulic pump 3 out to maximum displacement volume $V_{max}$. With increasing actuating pressure in the actuating chamber 18, the hydraulic pump 3 is swivelled back in the direction of minimum displacement volume $V_{min}$.

Situated in a capacity control line 21 is a capacity control valve 22, which in the embodiment takes the form of a pressure relief valve. The capacity control valve 22 is connected by a preferably adjustable coupling spring 23 to the linkage 17 of the adjusting device 15. The coupling spring 23 preferably comprises a spring set comprising a plurality of springs of differing spring constant, so that the force-displacement diagram of the coupling spring 23 has, not a linear, but a progressive characteristic. With progressive swinging of the displacement volume of the hydraulic pump 3 back in the direction of minimum displacement volume $V_{min}$, the linkage 17 of the adjusting apparatus 15 transmits a progressively larger force to the capacity control valve 22.

When a countervailing force, which is generated by the pressure upstream of the capacity control valve 22 in the capacity control line 21 via the detour line 24, is greater than the force generated by the bias of the coupling spring 23, the capacity control valve 22 opens the capacity control line 21 towards the hydraulic fluid tank 12. This opening is effected until the pressure in the capacity control line 21 has dropped far enough for there to be an equilibrium of forces between the force exerted by the coupling spring 23 and the countervailing force exerted by the pressure in the capacity control line 21. The maximum pressure prevailing in the capacity control line 21 is consequently all the higher, the further the adjusting apparatus 15 has swung the displacement volume of the hydraulic pump 3 in the direction of the minimum displacement volume $V_{min}$. The use of a coupling spring 23 with a progressive shape of the force-displacement characteristic leads to an approximately hyperbolic relationship between the pressure prevailing in the capacity control line and the displacement volume set by the adjusting device 15, so that the product of pressure and displacement volume, i.e. the maximum hydraulic capacity, is constant.

The capacity control valve 22 cooperates with a control valve 25, to which is assigned exclusively the function of capacity limitation but not of volumetric flow control.

For volumetric flow control a separate volumetric flow control valve 26 is provided. By separating the functions of capacity limitation and volumetric flow control, it is possible to vary the set, limiting maximum capacity.

The control valve 25 is connected by a connection line 27 to the working line 13 upstream of the volumetric flow throttle 14 and by a connection line 28 to the capacity control line 21 upstream of the capacity control valve 22. The control valve 25 in the illustrated embodiment takes the form of a 3/2-way valve and is set by the difference between the working pressure prevailing in the working line 13 and the capacity control pressure prevailing in the capacity control line 21 upstream of the capacity control valve 22. Acting upon the valve piston 29 of the control valve 25, moreover, are a force exerted by a preferably adjustable first resetting spring 30 and, in the embodiment of FIG. 1, an additional force exerted by an actuator 31. The additional force exerted by the actuator 31 in said case acts in an equivalent manner to the capacity control pressure in the capacity control line 21 and counter to the working pressure in the working line 13. The actuator 31 preferably takes the form of an electromagnet, in particular a proportional magnet, the actuating force of which is proportional to the exciting current intensity.

Provided the force generated by the working pressure in the working line 13 is lower than the countervailing force generated by the capacity control pressure, the resetting spring 30 and the actuator 31, a valve piston 29 of the control valve 25 is situated in its first valve position 32 illustrated in FIG. 1 and connects the actuating chamber 18 of the adjusting device 15 by the volumetric flow control valve 26 to the hydraulic fluid tank 12. So long as the capacity limitation of the capacity control apparatus does not respond, the control of the displacement volume of the hydraulic pump 3 is effected exclusively by means of the volumetric flow control valve 26.

If, however, the force generated by the working pressure in the working line 13 exceeds the countervailing force generated by the capacity control pressure in the capacity control line 21, the resetting spring 13 and the actuator 31, then the control valve 29 is displaced into its second valve position 33, so that the working line 13 is connected by the control valve 25 and the volumetric flow control valve 26 to the actuating chamber 18 of the adjusting apparatus 15. Consequently, the displacement volume of the hydraulic pump 3 is swung back in the direction of minimum displacement volume $V_{min}$ when the capacity control apparatus responds. Because of the swing back in the direction of minimum displacement volume $V_{min}$, the retroactive force exerted by the coupling spring 23 upon the capacity control valve 22 is increased. This allows a higher capacity control pressure in the capacity control line 21 upstream of the capacity control valve 22. The resetting in the direction of minimum displacement volume $V_{min}$ is therefore effected only until a state of equilibrium is reached. Basically, this state of equilibrium arises at a displacement volume of the hydraulic motor 3 that is all the lower, the greater the working pressure in the working line 13 is. Given a suitable characteristic of the coupling spring 23, the effect may be achieved that the product of working pressure in the working line 13 and displacement volume of the hydraulic pump 3 is limited to a constant maximum value.

The supply to the control apparatus is effected via an intake throttle 34, which connects the capacity control line 21 to the working line 13 in a throttled manner.

The actuating pressure generated by the control valve 25 is overridden by the volumetric flow control valve 26. The volumetric flow control valve 26 is disposed in an actuating pressure line 35, which extends from the control valve 25 to the actuating chamber 18. The volumetric flow control valve 26 in the illustrated embodiment likewise takes the form of a 3/2-way valve. The actuating pressure line 35 is connected between the volumetric flow control valve 26 and the control valve 25 by a first relief throttle 36 to the hydraulic fluid tank 12. Between the volumetric flow control valve 26 and the actuating chamber 18 the actuating pressure line 35 and/or the actuating chamber 18 is connected by a second relief throttle 37 to the first relief throttle 36.

The volumetric flow control valve 26 is connected by a first pressure line 38 to the working line 13 upstream of the volumetric flow throttle 14 and by a second pressure line 39 to the working line 13 downstream of the volumetric flow throttle 14. So long as the capacity control apparatus comprising the capacity control valve 22 and the control valve 25 does not respond, the displacement volume of the hydraulic pump 3 is set in such a way that there is a constant volumetric flow through the volumetric flow throttle 14. For this purpose, the volumetric flow control valve 26 is acted upon via the pressure lines 38 and 39 by the pressure drop at the volumetric flow throttle 14. If the pressure drop at the volumetric flow throttle 14 and hence the volumetric flow through the volumetric flow throttle 14 increases, then the volumetric flow control valve 26 is displaced from its first valve position 40 in the direction of its second valve position 41, so that the actuating pressure in the actuating chamber 18 is increased and the displacement volume of the hydraulic pump 3 is swung back in the direction of minimum displacement volume $V_{min}$. This in turn leads to a reduction of the volumetric flow through the volumetric flow throttle 14 and hence of the pressure drop at the volumetric flow throttle 14, so that at the volumetric flow control valve 26 a state of equilibrium arises. The volumetric flow apportioned to the connected consumer is variable by varying the cross section of the preferably adjustable volumetric flow throttle 14.

The hydraulic force from the second pressure line 39 acts together with the force of a setting spring 43 upon a measuring surface 48 of the valve piston. To prevent dirt accumulating in the region of the measuring surface 48, according to the invention a pressure chamber 45 is formed, which is connected by a counterpressure line 44 to the working line 13 upstream of the volumetric flow throttle 14. Via the counterpressure line 44 the pressure chamber 45 is loaded with a higher pressure than the measuring surface 48. The result is the formation of a leakage path, which runs from the pressure chamber 45 in the direction of the second pressure line 39. As a result of this targeted leakage, the feed of clean hydraulic fluid into the pressure chamber 45 prevents dirt particles from being able to travel through the second pressure line 39 to the measuring surface 48 and deposit there.

The pressure chamber 45 is delimited by two oppositely oriented surfaces 46' and 46". The pressure supplied through the counterpressure line 44 therefore does not give rise at the valve piston to any force in axial direction because the effective forces at the oppositely oriented surfaces 46' and 46" cancel each other out. The actual control of the volumetric flow control valve 26 is therefore effected exclusively as a function of the pressure in the first pressure line 38 and of the pressure in the second pressure line 39.

The fact that the control of the volumetric flow is effected at a volumetric flow control valve 26 that is separate from the control valve 25 ensures that the characteristic of the volumetric flow control remains uninfluenced by a variation of the maximum capacity preset by the actuator 31. By means of the additional force generated by the actuator 31, the equilibrium between the working pressure and the capacity control pressure is shifted. As the additional force generated by the actuator 31 increases, given the same capacity control pressure in the capacity control line 21 a higher working pressure is needed in the working line 13 to actuate the control valve 25. Consequently, as the additional force summoned up by the actuator 31 increases, a progressively higher maximum capacity is set. When the actuator 31 takes the form of an electromagnet, the maximum capacity, to which the control apparatus 1 limits, is all the higher, the greater the current flowing through the electromagnet. In the event of power failure, the control apparatus 1 therefore limits to the smallest possible maximum capacity, thereby ensuring operational safety.

FIG. 2 shows an embodiment of a valve block 50, which may be used for the control apparatus 1 illustrated in FIG. 1. The control valve 25 and the volumetric flow control valve 26 are integrated in a particularly compact manner in the valve block 50. FIG. 3 shows a hydraulic equivalent circuit diagram of the valve block 50 illustrated in FIG. 2. As a comparison with FIG. 1 reveals, the style of construction of the valve block corresponds to the configuration of the valves 25 and 26 in FIG. 1. Elements that have already been described are therefore provided with identical reference characters.

The valve block 50 comprises a total of five connections, which are also indicated in FIG. 3, namely a working pressure connection P, an actuating pressure connection A, a tank connection T, a capacity control connection $X_1$ and a volumetric flow control connection $X_2$. The capacity control connection $X_1$ and the volumetric flow control connection $X_2$ are not visible in FIG. 2.

Introduced into a basic body 51 of the valve block 50 are a first transverse bore 52 for the control valve 25 and a second transverse bore 53 parallel thereto for the volumetric flow control valve 26. The transverse bores 52, 53 are closed in each case by a thread plug 54 and 55 respectively. A valve sleeve 57, in which the valve piston 29 of the control valve 25 is axially movable, is inserted into the first transverse bore 52. The valve piston 29 has a first annular recess 56, which is connected by a connection channel 58 to the working pressure connection P. The annular recess 56 is adjoined by a region 59 of widened diameter, on which a first control edge 60 is formed. The valve piston 29 moreover has a second annular recess 61, which is connected by a connection channel 62 to the tank connection T. The second annular recess 61 is adjoined by a region 92 of widened diameter, on which a second control edge 63 is formed.

As the valve piston 29 of the control valve 25 in its inoperative position shown in FIG. 2 has been displaced by the first resetting spring 30 in FIG. 2 to the left, the second control edge 63 is open and a further connection channel 64 is connected by the connection channel 62 to the tank connection T. The annular recess 56 is connected by a longitudinal bore 65, which is formed in the valve piston 29, to a first pressure chamber 67 formed between a first pressure working surface 66 and the plug 55. Consequently, the pressure working surface 66 formed by the left end face of the valve piston 29 is loaded with the working pressure. The capacity control pressure, which is supplied through the capacity control connection $X_1$ not shown in FIG. 2 to a second pressure chamber 68, acts upon a second pressure working surface 69, which forms the right end face of the valve piston 29. The first resetting spring 30 moreover acts upon this end face of the valve piston 29 via a spring cup 70. The bias the first resetting spring 30 may be varied by adjusting the spring abutment body 71 in the receiving body 72.

The additional force generated by the actuator 31 in the form of an electromagnet is introduced by means of a push rod 73 into the valve piston 29. The higher the electric current flowing through the electromagnet in the form of a proportional magnet, the higher the additional force exerted upon the valve piston 29. The valve piston 29 is therefore set in such a way that the actuating force exerted by the working pressure counterbalances the countervailing force bridged out by the capacity control pressure, the first resetting spring 30 and the actuator 31.

The intake throttle 34 is advantageously integrated in the valve block 50 between the working pressure connection P and the second pressure chamber 68. The longitudinal bore 65 in the valve piston 29 is particularly advantageously suited for this purpose. The longitudinal bore 65 is connected by a first transverse bore 74 to the annular recess 56 and hence to the working pressure connection P. A throttling transverse bore 75 of a smaller cross section connects the longitudinal bore 65 to the second pressure chamber 68.

A second valve piston 76 for the volumetric flow control valve 26 is inserted, in the illustrated embodiment, directly into the second transverse bore 53. The valve piston 76 has a first annular recess 77, which is connected by the connection channel 58 to the working pressure connection P. The first annular recess 77 is adjoined by a region 78 of widened diameter, on which a first control edge 79 is formed. A second annular recess 80 is moreover formed at the valve piston 76 and connected to the connection channel 64. The second annular recess 80 is adjoined by a region 81 of widened diameter, on which a second control edge 82 is formed. In the illustrated inoperative position, the second valve piston 76 has been pressed by the second resetting spring 42, which in the illustrated embodiment is composed of two individual springs 42*a* and 42*b*, against its, in FIG. 2, left stop so that the second control edge 82 is open. The individual springs 42*a* and 42*b* of the second resetting spring 42 lie against a spring cup 83, which is held in abutment against the second valve piston 76. In the receiving body 84 screwed into the basic body 51 an adjusting device 85 is situated, which is accessible from the outside and by means of which the axial position of a second spring cup 86 and hence the bias of the second resetting spring 42 is variable.

Situated in the second valve piston 76 is a longitudinal bore 87 in the form of a blind hole, which opens out at a third pressure chamber 88 formed between the plug 54 and the second valve piston 76, so that the third pressure chamber 88 is connected to the working pressure connection P. The working pressure supplied through a first connection bore 100 and the longitudinal bore 87 in said case acts upon a first pressure measuring surface 89 of the second valve piston 76.

The second pressure line 39 fed to the volumetric flow control connection $X_2$ is connected to a fourth pressure chamber 90, so that a second pressure measuring surface 91 of the second valve piston 76 is loaded with a pressure from the working line downstream of the volumetric flow control valve 14. The position of equilibrium of the second valve piston 76 is therefore determined by the difference between the working pressure and the pressure at the volumetric flow control connection $X_2$.

The second pressure measuring surface 91 is delimited by a first sealing portion 102. In the direction of the first measuring surface 89 a second sealing portion 103 is formed on the valve piston 76, so that between the first sealing portion 102 and the second sealing portion 103 a further annular recess 101 is formed. The annular recess 101 together with the transverse bore 53 of the basic body 51 forms an annular channel as a pressure chamber. The longitudinal bore 87 running in the interior of the valve piston 76 extends from the first pressure measuring surface 89 into the region of the annular recess 101. The valve piston 76 is penetrated in the region of the annular recess 101 by a further connection bore 104. The annular channel formed in the region of the annular recess 101 is therefore permanently connected by the connection bore 100, the longitudinal bore 87 and the further connection bore 104 to the working pressure connection P.

The first sealing portion 102 and the second sealing portion 103, at the side facing the annular channel, each have a surface 105' and 105" respectively, which are oppositely oriented and of equal size. The hydraulic fluid supplied through the further connection bore 104 therefore does not exert on the valve piston 76 any force that displaces the valve piston 76 in axial direction. Along the first sealing portion 103, by virtue of the use of a suitable fit, a leakage path is formed, so that from the annular channel a low fraction of leakage fluid flows in the fourth pressure chamber 90. By virtue of this low flow, a defined leakage flow is adjusted at the first sealing portion 102 and comprises clean leakage fluid. This prevents dirt particles, given a reverse leakage path, from leading to destruction of the sealing surfaces of the transverse bore 53 and/or of the valve piston 76.

In the region of the connection channel 62 the valve piston 76 has a bushing 93.

From the fourth pressure chamber 90 an oblique longitudinal bore 94 extends up to the actuating pressure connection A. This longitudinal bore 94 is interrupted by a plug 95, so that there is no direct connection from the tank connection T to the fourth pressure chamber 90. Situated in the region of penetration between the connection channel 64 and the longitudinal bore 94 is a plug 96, in which a blind hole 97 is formed. The blind hole 97 is connected by a first transverse bore 98, which forms the first relief throttle 36, to the tank connection T. The blind hole 97 is further connected by a second transverse bore 99, which forms the second relief throttle 37, to the actuating pressure connection A. By rotating the plug 96 the opening cross section, which arises from overlapping of the transverse bores 98 and 99 with the cross section of the longitudinal bore 94, may be adjusted.

Instead of the embodiment illustrated in FIGS. 1 to 3, it is also conceivable to use the invention in other control devices. The provision of a manual adjusting device 85' and 80' instead of the electromagnet 31 is illustrated by way of example in Figures four to six. The manual adjusting device 85' comprises a spring cup 86', against which the resetting spring 30 as well as an additional resetting spring 30' are supported. By virtue of the use of two springs, the superimposed force of which determine the adjustment characteristic of the control valve 25, it is possible to effect an adaptation of the characteristic of the control valve 25 to a capacity hyperbola. For the control valve 25, the formation of a leakage path is likewise possible so that, here too, the depositing of dirt is to be avoided.

The invention claimed is:

1. A control apparatus for a hydraulic pump, which delivers into at least one working line a displacement volume of a flow which is adjustable by an adjusting device, wherein the adjusting device is loadable with an actuating pressure by an actuating pressure connection, which is controlled by a control valve as a function of a first pressure and a second pressure, wherein a first pressure line has the first pressure load a first measuring surface and a second pressure line has the second pressure load an opposed second measuring surface of a volumetric flow control valve and wherein the first pressure is higher than the second pressure, wherein a pressure chamber is formed between the first and the second measuring surface and a leakage path connects the pressure chamber to the second pressure line, wherein the pressure chamber is connected by a counterpressure line to the first pressure line, while also being arranged separately from the actuating pressure connection, and wherein said pressure chamber has the form of an annular chamber with a first delimiting portion and a second delimiting portion, each said portion having an oppositely oriented surface, which surfaces are equally sized for preventing any force from displaying a piston of the volumetric flow control valve.

2. The control apparatus according to claim 1, wherein the first pressure line is connected to a delivery-side working line connection, which is connected to a working line.

3. The control apparatus according to claim 1, wherein the second pressure line is connected to a working line in a flow direction downstream of a throttle point which is disposed in the working line.

4. The control apparatus according to claim 1, wherein the control valve has a gronnd body with a bore in which a piston is movably inserted, whereby the piston has a first annular recess forming a chamber within the bore which is connected to the first pressure line, and a second annular recess forming a second chamber within the bore which is connectable to a tank pressure, and the actuating pressure connection is selectively connectable with the first or second annular recess dependent upon the position of the piston and the pressure chamber which is connected by a counterpressure line to the first pressure line being located beyond the second annular recess with regard to the first annular recess.

5. A valve block for a control apparatus, comprising at least one recess for receiving a valve piston, which controls an actuating pressure directed to an actuating pressure connection and which has a first measuring surface and a second, oppositely measuring surface, wherein the first measuring surface is loadable via a first pressure line with a first pressure and the second measuring surface is loadable via a second pressure line with a second pressure which is lower than the first pressure, wherein a sealing portion is formed at the valve piston, on the side of which there is provided a pressure chamber that is remote from the second measuring surface, wherein the sealing portion forms a leakage path from the pressure chamber into the second pressure line, wherein the pressure chamber is connectable by a counterpressure line to the first pressure line, and is arranged separately from the actuating pressure connection, said pressure chamber having the form of an annular chamber with the sealing portion and a further delimiting sealing portion, each said sealing portion having an oppositely oriented surface, which are eciually sized for preventing any force from displacing a piston of the volumetric control valve.

6. The valve block according to claim 5, wherein the valve block has a ground body with a bore in which the valve piston is movably inserted, the bore and the movable valve piston forming a first annular recess connectable to the first pressure line, and the second annular recess being connectable to a tank pressure, the actuating pressure connection being selectively connectable with the first or second annular recess dependent upon the position of the valve piston and the pressure chamber, which is connected by a counterpressure line to the first pressure line, being located beyond the second annular recess with regard to the first annular recess.

* * * * *